United States Patent [19]

Gualdi

[11] 4,220,285

[45] Sep. 2, 1980

[54] HAND SPRAYER FOR LIQUIDS

[75] Inventor: Piero Gualdi, S. Felicino, Italy

[73] Assignee: Spray Plast S.r.1, Romano d'Ezzelino, Italy

[21] Appl. No.: 843,034

[22] Filed: Oct. 17, 1977

[30] Foreign Application Priority Data

Oct. 18, 1976 [IT] Italy ..... 28432 A/76

[51] Int. Cl.[2] ..... B05B 9/043; B05B 1/34

[52] U.S. Cl. ..... 239/309; 239/333; 239/493; 239/590; 222/80; 222/383

[58] Field of Search ..... 239/309, 327, 333, 493, 239/590; 222/80, 207, 383, 189, 464; 215/250

[56] References Cited

U.S. PATENT DOCUMENTS

| | | | |
|---|---|---|---|
| 3,088,617 | 5/1963 | Krautkramer | 215/250 |
| 3,618,669 | 11/1971 | Sachs | 239/309 X |
| 3,685,739 | 8/1972 | Vanier | 222/383 X |
| 3,714,967 | 2/1973 | Zupan et al. | 222/464 X |
| 3,788,549 | 1/1974 | Ostrowsky | 239/309 |
| 3,865,313 | 2/1975 | Kondo | 239/333 |
| 3,897,006 | 7/1975 | Tada | 239/333 |
| 4,078,726 | 3/1978 | Walto | 239/590 X |

FOREIGN PATENT DOCUMENTS

| | | | |
|---|---|---|---|
| 2446950 | 8/1975 | Fed. Rep. of Germany | 239/333 |

*Primary Examiner*—Robert W. Saifer
*Attorney, Agent, or Firm*—Fleit & Jacobson

[57] ABSTRACT

Disclosed herein is a hand operated sprayer for liquids, in which the spraying unit is provided with a small bore which is factory sealed at the assembly by a special fitting properly located, to be eliminated by the pumping lever when first operated, said bore communicating with the inner space of the container.

9 Claims, 9 Drawing Figures

HAND SPRAYER FOR LIQUIDS

BACKGROUND OF THE INVENTION

The present invention relates to a hand operated sprayer or atomizer for liquids of the type usually mounted on top of a container where an opening is provided, said sprayer being equipped with a hand operated pump which sucks the liquid from said container and sprays it through a nozzle.

Quite a few types of sprayers are on the market; they have different degrees of efficiency in spraying the liquid sucked from the container and pumping it through the nozzle. Depending on the adjustment of the nozzle with the spraying cone, the dimensions of the atomized particles and the throw distance of the liquid can be varied. No matter what their shape, the working principle is the same for all such sprayers. They have quite a few deficiencies: lack of reliability, elevated cost because of the great number of components and therefore of the long assembly time, objectionable liquid leaking from the nozzle in case of transport of the containers, and a possibility of tampering with the container to unduly modify the quantity or quality of the contents.

SUMMARY AND OBJECTS OF THE INVENTION

The scope of the present invention is to obviate these drawbacks, that is to produce a hand operated sprayer, which is equipped with a safety seal functioning as a plug during transport and which is as cheap to produce as possible, though assuring an excellent operation.

The above mentioned goal has been reached, according to the present invention, by providing the sprayer with a small bore working as an air intake, and with a pumping lever which, when plunged by a finger at first operation, automatically tears off a safety seal associated with the small bore air intake, thus letting the air into the sprayer tank, and consequently the liquid out of the sprayer tank.

According to an improvement of the invention, the spraying nozzle can work as a valve, and as a plug when a ring nut of the nozzle is screwed on its seat.

According to a further improvement the valve casing, that is the housing where the valve ball is seated, is provided in a single piece. That feature has never been disclosed before.

Another improvement of the invention consists in integrating the pumping lever together with the sprayer body, reducing also in this way the number of necessary components.

A further improvement of the invention provides for the sprayer mounting to be screwed on the container with an indented joint, and shaped to make it impossible to remove the above mentioned mounting without breaking some teeth of said indented joint and consequently making the tampering or misusing evident.

Another improvement of the invention provides for the suction filter of said sprayer to be made in a single piece and mounted outside the pipe. That further cuts down both assembly and manufacture times.

The invention will now be better described with an embodiment which has been illustrated in the figures herewith attached which will by no means be considered as limitative.

DESCRIPTION OF THE PREFERRED EMBODIMENT

Figure 1:
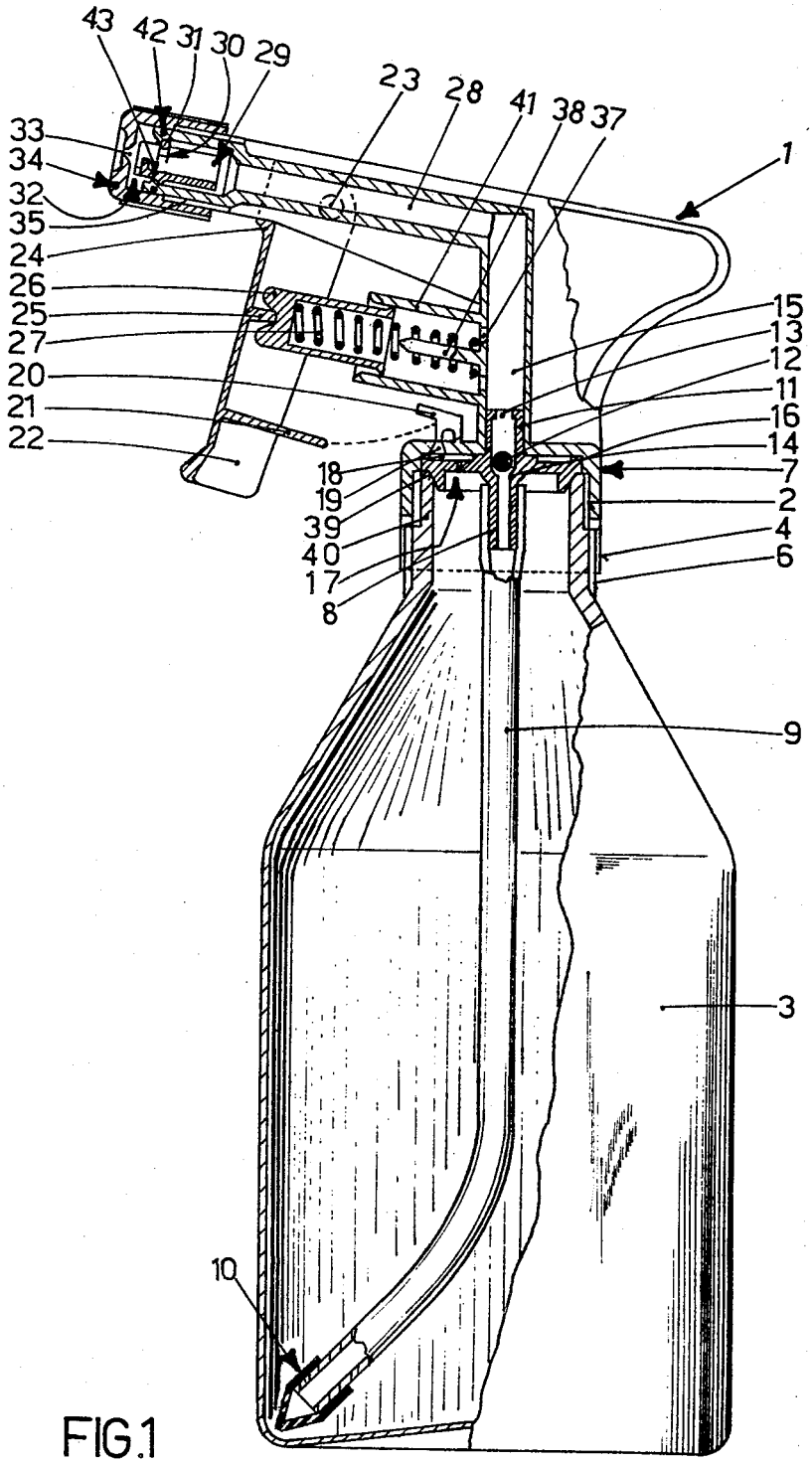
FIG. 1 is a partial cutaway of a sprayer where all details can be traced.

According to one of the preferred embodiments of the present disclosure represented in the attached drawings, the sprayer consists of very few components, and precisely:

a. sprayer body 1;

b. lever 22 for hand pump operating;

c. pump piston 26 with spring 27;

d. diffuser 29, complete with ring nut 34 and "O" ring 42;

e. valve casing 7 complete with ball.

Figure 5:
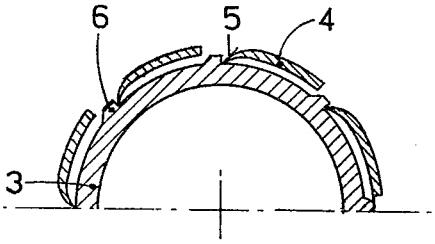
FIG. 5 is a section of the spraying unit and of the container through the seal.
Figure 6:
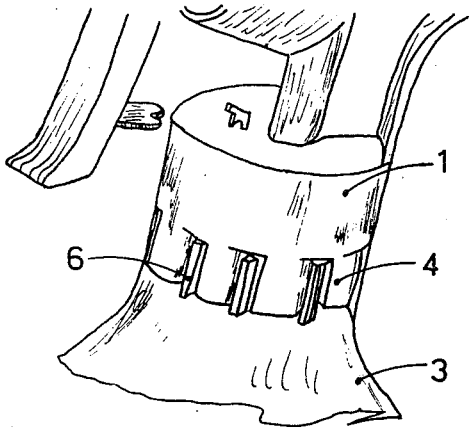
FIG. 6 is an axonometric view of the seal.

The sprayer body 1 is equipped at its lower end with mounting 2 to be connected with tank 3, whereas the extensions 4 of the mounting are equipped with teeth 5 (FIG. 5) which are elastically engaged with just as many teeth 6 provided in the container. In the event that the sprayer is screwed off from the tank a chipping of teeth 5 occurs, which in such a way acts as an indication of tampering.

Figure 4:
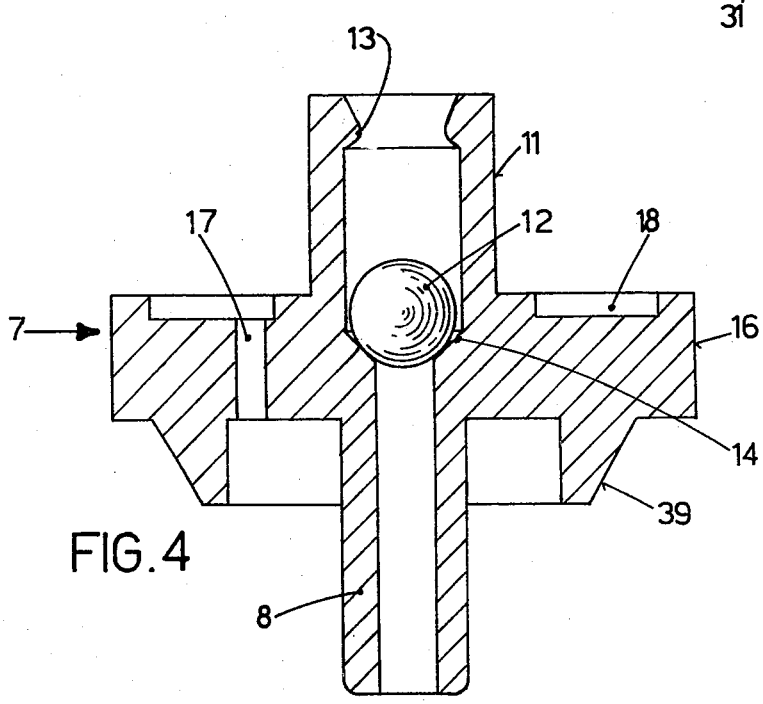
FIG. 4 is an enlarged section of the valve casing 7 of FIG. 1.

The valve casing 7 (FIG. 4) is positioned between the opening of container 3 and the mounting upper section and is equipped with tang 8 fit for receiving pipe 9. The upper section of the valve casing houses tang 11, on which ball 12 is inserted (which works as an intake valve) and pressed elastically against undercut 13. The aforesaid ball 12 will consequently seat tightly on the conical surface 14. The tang 11, in turn, nests tightly within duct 15 of valve casing 1, being coupled with it; the same thing is true with respect to surface 16 (on the maximum outer diameter of the valve casing) and the cylinder surface adjacent to the bottom of mounting 2, and the conical outer surface 39 of the valve casing tightly engages edge 40 of the opening of container 3.

The relief bore 17 communicates between the outside and the space included within container 3 through relief ring 18. The bore 19, drilled through mounting 2, is situated in front of relief bore 17 upon assembly, and is covered with fitting 20 upon assembly. Consequently, no air flow into the container 3, and no liquid flow therefrom, are possible.

As soon as pumping lever 22 is operated, a projecting lip 21 will allow air in by breaking fitting 20 (which makes the container leakproof during transport). This dissociation takes place automatically at the first pumping stroke.

Figure 9:
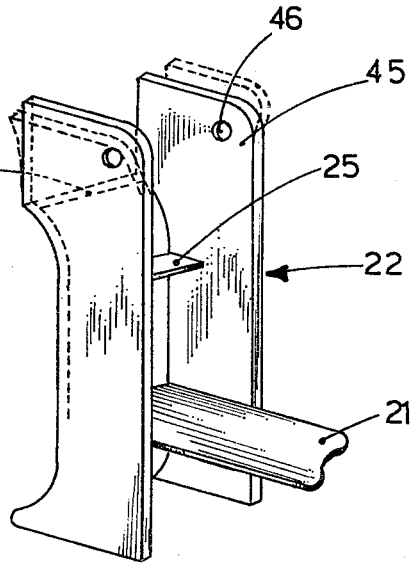
FIG. 9 is an axonometric view of the pump operating lever.

Lever 22 (FIG. 9) is mounted with elastically deformable sides 45 on pins 23 (projecting from the body) which have a fulcrum function by being inserted into holes 46 existing on the sides of the lever. The edge 24 of lever 22 has a stop function for the previously mentioned lever. The rib 25 on the lever acts as a fulcrum for piston 26 which works within cylinder 41 mounted on the side of sprayer unit 1 and undergoes displacement by lever 22, getting back to rest position because of the force of spring 27 which is guided by pin 38 located on sprayer unit 1 so that the spring remains coaxial with cylinder 41.

Figure 2:
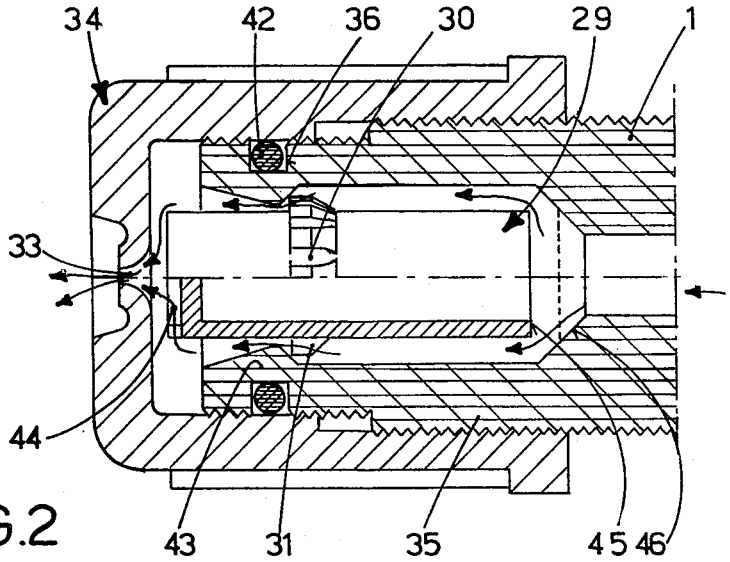
FIG. 2 is an enlargement of a section of the nozzle functioning as a plug.
Figure 3:
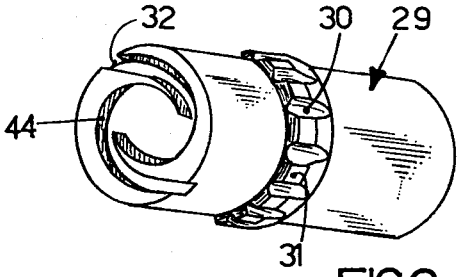
FIG. 3 is an axonometric view of the inner unit of the spraying nozzle.

The piston 26 pumps the liquid through holes 37, then the liquid rises from duct 15 to duct 28 and passes through ducts 30 of FIG. 2 (provided on rib 31 located around diffuser 29) and penetrates into spiral 44 (FIG. 3) situated in front of the diffuser 29, passing next through side holes 32 and getting out through hole 33 of ring nut 34, nebulized or concentrated depending on the position of ring nut 34, adjusted by means of threading 35. Tightness between the diffuser 29 and ring nut 34 is obtained by means of gasket 42 housed within groove 36 located in sprayer body 1 around diffuser 29. The tightness on the sprayer head is guaranteed by screwing the nozzle all the way down, to press edge 45 of diffuser 29 against the coneshaped surface 46 of sprayer unit 1. The diffuser 29 holds to sprayer unit 1, because the sprayer unit is equipped with one or more inner projecting-parts 43 abutting ribs 31 (see FIG. 2) on diffuser 29.

Figure 7:
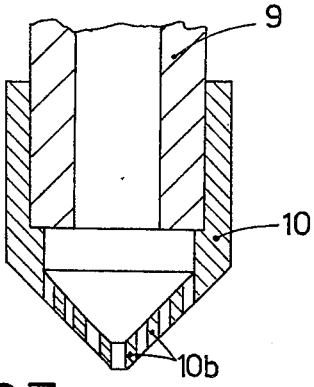
FIG. 7 is a section of the suction filter 10 of FIG. 1.
Figure 8:
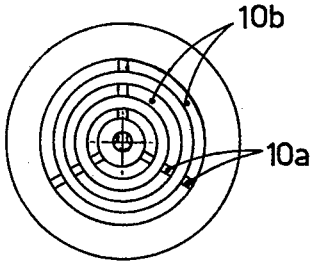
FIG. 8 is a bottom view of the filter represented in FIG. 7.

The suction filter 10 (FIGS. 7 and 8) is preferably designed as a single piece, and is mounted on the outside of suction pipe 9. Instead of being equipped with a mesh filter, suction filter 10 is formed in a point-like structure (see FIG. 7) consisting of a set of small cylinders (**10*b*) decreasing in diameter and connected to one another by means of crosspieces 10*a* (see FIG. 8**).

Assembly is easy: valve ball 12 is inserted into valve casing 7 (pressing it against undercut 13) which is inserted into sprayer unit 1. Then spring 27 is inserted into pin 38 of cylinder 41; piston 26 is assembled, and then lever 22 is assembled, forcing it elastically on the two pins 23 of sprayer unit 1. Next, "O" ring gasket 42 is mounted into the groove 36 of sprayer body 1 surrounding diffuser 29 (forcing it slightly against undercut 43), and then ring nut 34 is screwed in place. Filter 10 is mounted on suction pipe 9 and this is mounted on tang 8 of valve casing 7, and all is ready to be screwed on container 3, previously filled with liquid.

Of course the disclosure is not limited to the sample design described and illustrated, but includes all and any modifications of details, implying an equivalent functioning.

What is claimed is:

1. A hand operated sprayer for use with a liquid, comprising in combination:

a tank containing the liquid to be sprayed;

a sprayer body fastened to said tank and provided with a squeezable lever; and means to vent said tank comprising a passageway in said tank to allow said tank to communicate with ambient air, and a rupturable fitting integrally formed with said sprayer body for sealing said passageway, said lever including rod means responsive to said lever being squeezed a first time for permanently opening said passageway and for simultaneously providing a permanent visual indication that the sprayer has been used by irreplaceably rupturing said rupturable fitting;

wherein said sprayer body includes nozzle means for modifying spray nebulization, comprising:

a ring nut threaded on said sprayer body and including means defining an opening along a longitudinal axis at one extremity thereof, a diffuser disposed within said sprayer body and said ring nut, and including ribs, said sprayer body including inner projections, said diffuser being capable of abutting against said sprayer body along a conically tapering surface, and said diffuser being further retained within said sprayer body by cooperation of said ribs on said diffuser with said inner projections on said sprayer body, and an O ring disposed in a peripheral groove on said sprayer body underlying said ring nut to prevent liquid seepage.

2. The device of claim 1 wherein said passageway includes a first bore and a second bore separated from each other by a relief ring.

3. The device of claim 2 wherein said rod means comprises an integral lip portion for irreplaceably rupturing said rupturable fitting.

4. The device of claim 3 wherein said lever further includes a pivot to said sprayer body remote from said integral lip portion, and a rib disposed between the lip and the pivot, said rib serving to depress a biased piston formed on said sprayer body to pump the liquid.

5. The device of claim 4 wherein said piston communicates with a duct in said sprayer body extending from said tank through said sprayer body, and wherein said biased piston rides in a cylinder.

6. The device of claim 2 wherein said sprayer body is fastened to said tank by means of a threaded mounting having rupturable teeth therebetween, whereby removal of said mounting destroys the teeth, and therefore the fastening.

7. The device of claim 1 wherein said tank is provided with a receiving pipe for pumping out the liquid, said receiving pipe including a terminal portion located at a lower extremity of said tank and a filter sleeve overlying said terminal portion of said pipe, said filter sleeve comprising a plurality of small concentric cylinders interconnected by crosspieces.

8. The device of claim 7 wherein said receiving pipe is connected to a valve casing in said sprayer body having a ball valve disposed in a tang which communicates with said pipe, and wherein said ball valve is entrained in said tang by an undercut at one extremity thereof and a ball seat at the other extremity thereof.

9. The device of claim 1 wherein said diffuser further includes, on an end remote from said conical surface, spiral passageways terminating in plural holes along the outer periphery thereof, and said ribs on said diffuser are provided with openings along interstices thereof to allow liquid to pass to the spiral passageways.

* * * * *